US008082655B2

(12) United States Patent
Chung et al.

(10) Patent No.: US 8,082,655 B2
(45) Date of Patent: Dec. 27, 2011

(54) INTEGRATED WINDING STRUCTURE FOR A MAGNETIC CORE

(75) Inventors: Chu T. Chung, Cary, NC (US); Chien H. Lin, Taipei (TW); Randhir S. Malik, Cary, NC (US); Robert Wei, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 13/103,802

(22) Filed: May 9, 2011

(65) Prior Publication Data

US 2011/0209340 A1 Sep. 1, 2011

Related U.S. Application Data

(62) Division of application No. 12/171,557, filed on Jul. 11, 2008, now Pat. No. 7,999,647.

(51) Int. Cl.

| | |
|---|---|
| ***H01F 7/06*** | (2006.01) |
| ***H01F 27/28*** | (2006.01) |
| ***H01F 27/24*** | (2006.01) |
| ***H01F 17/04*** | (2006.01) |

(52) U.S. Cl. ..... 29/602.1; 29/606; 336/212; 336/221; 336/223; 336/232; 336/233

(58) Field of Classification Search ..... 336/180, 336/212, 221, 223, 229, 232, 233; 29/602.1, 29/606

See application file for complete search history.

(56) References Cited

U.S. PATENT DOCUMENTS

| | | | | |
|---|---|---|---|---|
| 4,206,434 | A | 6/1980 | Hase | |
| 4,536,733 | A * | 8/1985 | Shelly | 336/182 |
| 6,784,644 | B2 | 8/2004 | Xu et al. | |
| 6,885,274 | B2 | 4/2005 | Hsu et al. | |
| 7,315,463 | B2 | 1/2008 | Schrom et al. | |
| 7,321,283 | B2 | 1/2008 | Mehrotra et al. | |
| 2004/0017276 | A1 * | 1/2004 | Chen et al. | 336/192 |

(Continued)

FOREIGN PATENT DOCUMENTS

WO 03088285 A1 10/2003

OTHER PUBLICATIONS

Office Action Received from USPTO, U.S. Appl. No. 12/171,557, Date: Apr. 28,2010.

(Continued)

*Primary Examiner* — Elvin G Enad
*Assistant Examiner* — Tsz Chan
(74) *Attorney, Agent, or Firm* — Kunzler Needham Massey & Thorpe

(57) ABSTRACT

A method includes forming a winding structure from a single sheet of electrically conductive material, where the winding structure includes a winding base and multiple winding extensions extending from the winding base as a continuous piece of the electrically conductive material. The multiple winding extensions include a base portion that extends from the winding base along a first face of a fully assembled magnetic core, a wrapping portion that extends from the base portion along a second face of the fully assembled magnetic core, and a connection portion that extends from the wrapping portion along a third face of the fully assembled magnetic core, the connection portion comprising an electrical connection surface. The base portion, the wrapping portion, and the connection portion of each winding extend from the winding base such that the integrated windin structure is shaped for placement over the full assembled magnetic core in a single motion.

7 Claims, 4 Drawing Sheets

U.S. PATENT DOCUMENTS

| | | | |
|---|---|---|---|
| 2006/0038650 | A1 | 2/2006 | Mehrotra et al. |
| 2006/0197385 | A1 | 9/2006 | Levin et al. |
| 2007/0090915 | A1 | 4/2007 | Zhou et al. |
| 2007/0176726 | A1 | 8/2007 | Xu et al. |
| 2008/0001693 | A1 | 1/2008 | Hahn et al. |

OTHER PUBLICATIONS

Final Office Action Received from USPTO, U.S. Appl. No. 12/171,557, Date: Oct. 18,2010.

* cited by examiner

INTEGRATED WINDING STRUCTURE FOR A MAGNETIC CORE

CROSS-REFERENCE TO RELATED APPLICATIONS

This is a divisional application of and claims priority to U.S. patent application Ser. No. 12/171,557 entitled APPARATUS, SYSTEM, AND METHOD FOR AN INTEGRATED WINDING STRUCTURE FOR A MAGNETIC CORE and filed on Jul. 11, 2008 for Chu T. Chung et al., which is incorporated herein by reference.

BACKGROUND

1. Field of the Invention

This invention relates to magnetic cores and more particularly relates to integrated winding structures for magnetic cores.

2. Description of the Related Art

Many electrical applications make use of multiple magnetic cores and windings. Electric circuits for many devices have multiple inductors. For example, each phase of a multiphase converter or regulator uses a separate inductor. Other circuits use devices like transformers and coupled inductors that each have multiple sets of windings. These magnetic cores, like those found in inductors and transformers, are usually surface mounted components. Both multiple magnetic cores in a single circuit and magnetic cores with multiple sets of windings can be bulky and costly, increasing the size and the cost of electrical circuits and devices.

The manufacture and assembly of components like inductors and transformers that use magnetic cores can also be complicated and time consuming. Winding wire around a magnetic core can be both difficult to automate for manufacturing processes, and difficult to do manually. Devices that use multiple sets of windings can be even more difficult to manufacture.

SUMMARY OF THE INVENTION

From the foregoing discussion, it should be apparent that a need exists for an apparatus, system, and method that combine multiple windings on a magnetic core. Beneficially, such an apparatus, system, and method would simplify the manufacture and use of magnetic cores and windings.

The present invention has been developed in response to the present state of the art, and in particular, in response to the problems and needs in the art that have not yet been fully solved by currently available magnetic cores and windings. Accordingly, the present invention has been developed to provide an apparatus, system, and method for combining multiple windings on a magnetic core that overcome many or all of the above-discussed shortcomings in the art.

The apparatus to combine multiple windings on a magnetic core is provided with a plurality of elements. These elements in the described embodiments include an integrated winding structure, a winding base, multiple winding extensions, a base portion, a wrapping portion, and a connection portion.

The integrated winding structure, in one embodiment, comprises a winding base and multiple winding extensions extending from the winding base. In one embodiment, the multiple winding extensions and the winding base are formed from a single sheet of electrically conductive material as a continuous piece of the electrically conductive material. In a further embodiment, the winding base comprises an electrical connection surface.

In one embodiment, the multiple winding extensions each comprise a base portion, a wrapping portion, and a connection portion. The base portion, in one embodiment, extends from the winding base along a first face of the fully assembled magnetic core. In another embodiment, the wrapping portion extends from the base portion along a second face of the fully assembled magnetic core. In a further embodiment, the connection portion extends from the wrapping portion along a third face of the fully assembled magnetic core. In one embodiment, the connection portion comprises an electrical connection surface. In another embodiment, each wrapping portion substantially circumscribes the magnetic core one or more times. In another embodiment, the base portion, the wrapping portion, and the connection portion of each winding extend from the winding base such that the integrated winding structure is shaped for placement over the fully assembled magnetic core in a single motion.

In one embodiment, the magnetic is a C, E, bar, or toroid type magnetic core. In another embodiment, the magnetic core comprises multiple bound pieces. In a further embodiment, the magnetic core comprises an EIE type magnetic core with three bound pieces.

A system of the present invention is also presented to provide an integrated winding for an electronic device. The system may be embodied by an electronic device, a magnetic core, and an integrated winding structure. In particular, the system, in one embodiment, includes a circuit board.

Another apparatus to combine multiple windings on a magnetic core is provided. In one embodiment, the apparatus comprises a fully assembled magnetic core and an integrated winding structure. The integrated winding structure, in one embodiment, comprises a winding base and multiple winding extensions. In a further embodiment, the multiple winding extensions each comprise a base portion, a wrapping portion, and a connection portion.

A method of the present invention is also presented for manufacturing an apparatus to combine multiple windings on a magnetic core. The method in the disclosed embodiments substantially includes the steps necessary to carry out the functions presented above with respect to the operation of the described apparatuses and system. In one embodiment, the method includes forming an integrated winding structure from a single sheet of electrically conductive material. In one embodiment, the integrated winding structure includes a winding base and multiple winding extensions extending from the winding base as a continuous piece of the electrically conductive material, where the winding base includes an electrical connection surface. In a further embodiment, the multiple winding extensions each include a base portion configured to extend from the winding base along a first face of a fully assembled magnetic core, a wrapping portion configured to extend from the base portion along a second face of the fully assembled magnetic core, and a connection portion configured to extend from the wrapping portion along a third face of the fully assembled magnetic core, the connection portion comprising an electrical connection surface. In yet another embodiment, the base portion, the wrapping portion, and the connection portion of each winding extend from the winding base such that the integrated winding structure is shaped for placement over the fully assembled magnetic core in a single motion. The method also may include coating at least a portion of the integrated winding structure.

In a further embodiment, the method includes bending multiple winding extensions around a fully assembled magnetic core. The method, in another embodiment, includes pre-bending the integrated winding structure. In one embodiment, the method includes placing the integrated winding structure over the magnetic core in a single motion. In another embodiment, the method includes electrically attaching electrical connection surfaces of the integrated winding structure to a circuit board. In one embodiment, the multiple winding extensions are formed from the middle of a winding base.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
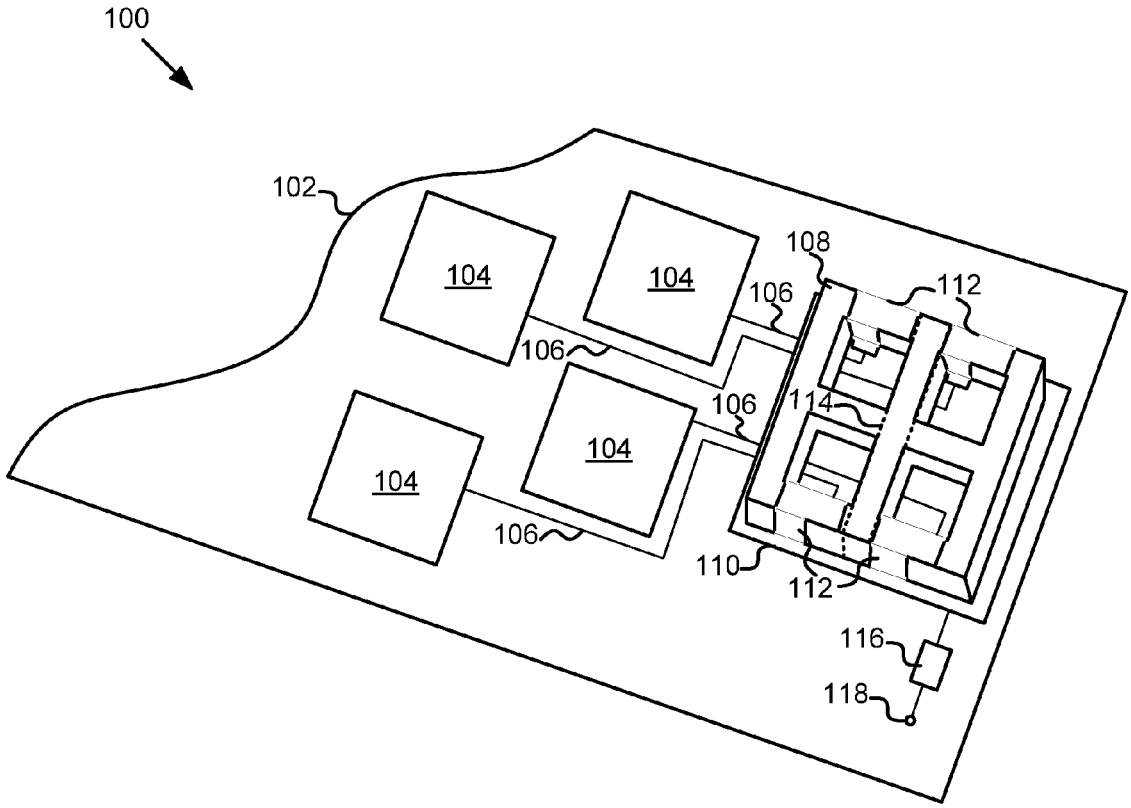
FIG. 1 is a schematic block diagram illustrating one embodiment of a system to provide an integrated winding for an electronic device in accordance with the present invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. Where a module or portions of a module are implemented in software, the software portions are stored on one or more computer readable media.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Reference to a computer readable medium may take any form capable of storing machine-readable instructions on a digital processing apparatus. A computer readable medium may be embodied by a transmission line, a compact disk, digital-video disk, a magnetic tape, a Bernoulli drive, a magnetic disk, a punch card, flash memory, integrated circuits, or other digital processing apparatus memory device.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIG. 1 depicts one embodiment of a system 100 to provide an integrated winding for a magnetic core. In one embodiment, the system 100 comprises a circuit board 102, one or more electrical devices 104, one or more electrical connections 106, a magnetic core 108, a winding base 110, multiple winding extensions 112, an output electrical device 116, and an output 118.

In one embodiment, the circuit board 102 comprises a printed circuit board. The circuit board 102 may comprise one or more electrical components, electrical connections, traces, inputs, outputs, and the like. In a further embodiment, the circuit board 102 is part of an electrical system, device, or the like, such as a power supply. The circuit board 102, in one embodiment, in addition to providing electrical connections for the system 100, may also comprise a support structure for the system 100.

In one embodiment, the one or more electrical devices 104 are electrically coupled to the circuit board 102. In a further embodiment, the one or more electrical devices 104 are physically mounted on the circuit board 102, and may be surface mount and/or through hole components. In one embodiment, the one or more electrical devices 104 comprise integrated circuits, discrete electrical components, or the like. In another embodiment, the one or more electrical devices 104 further comprise the one or more electrical connections 106, to connect the one or more electrical devices 104 to an inductor or a transformer. The one or more electrical devices 104 may comprise a single device or multiple devices. In one embodiment, the one or more electrical devices 104 comprise multiple phases of a converter or regulator.

In one embodiment, the one or more electrical connections 106 comprise connections between the one or more electrical devices 104 and the multiple winding extensions 112, such that the winding base 110 connects the outputs of the multiple winding extensions 112 in parallel. In an alternate embodiment, the one or more electrical connections 106 comprise one or more connections between the one or more electrical devices 104 and the winding base 110, such that the winding base 110 connects the inputs of the multiple winding extensions 112 in parallel. The one or more electrical connections 106 may comprise traces in the circuit board 102, wires, electrical connectors, or the like.

In one embodiment, the magnetic core 108 comprises a material suitable for use as an inductor or transformer core or the like. The magnetic core 108 may comprise a material having a high magnetic permeability that is also magnetically soft. In a further embodiment, the magnetic core 108 may comprise soft iron, silicon steel, carbonyl iron, hydrogen reduced iron, ferrite ceramics, and/or the like. The magnetic core 108, in another embodiment, may comprise a powdered core, a laminated core, a solid core, or the like. In one embodiment, the magnetic core 108 comprises a C (also referred to as a U), an E, a bar (also referred to as an I or a rod), or a toroid-type magnetic core. C-type cores include those comprising a C shaped core bound to one or more additional cores, such as additional C-type cores, I cores, or the like. Many arrangements are possible, including CC, CIC, CICC, and the like. E-type cores include those comprising an E shaped core bound to one or more additional cores, such as additional E-type cores, I cores, or the like. Many arrangements are possible, including EE, EIE, EWE, and the like. In the depicted embodiment, the magnetic core 108 comprises an E type core in an EIE configuration.

The magnetic core 108, in one embodiment, comprises a binding 114 between multiple pieces of the magnetic core 108. The binding 114 may comprise a glue, resin, clamp, brace, housing, or the like that binds the pieces of the magnetic core 108 together. In the depicted embodiment, the binding 114 binds an I core between the open ends of two E cores to form an EIE magnetic core.

In one embodiment, the winding base 110 and the multiple winding extensions 112 comprise an integrated winding structure that is formed from a single sheet of electrically conductive material. The winding base 110, in one embodiment, comprises an electrical connection surface that is suitable for use as an electrical input or output. In a further embodiment, the electrical connection surface of the winding base 110 comprises a tab, a pad, a port, a portion without a coating, a wire, or another surface disposed on the winding base 110 that is suitable for an electrical connection. In one embodiment, the winding base 110 comprises a single continuous piece of electrically conductive material. In another embodiment, the winding base 110 comprises multiple electrically isolated pieces of electrically conductive material, such that one or more of the multiple winding extensions 112 are electrically isolated from each other, for applications where it is undesirable for each of the windings on the magnetic core 108 to be in a parallel configuration.

In one embodiment, the winding base 110 is sized such that an assembler, manufacturer, or the like may place the winding base 110 over the magnetic core 108. The winding base 110 may be configured such that an assembler, manufacturer, or the like may place the winding base 110 over the magnetic core 108 in a single motion, without bending, wrapping, or otherwise adjusting the winding base 110 or the multiple winding extensions 112, In another embodiment, the winding base 110 is sized such that an assembler, manufacturer, or the like may place the magnetic core 108 substantially on top of the winding base 110, with the winding base 110 disposed substantially beneath and/or in the middle of the magnetic core 108. In a further embodiment, the winding base 110 may comprise an electrically insulating coating configured to prevent a short circuit between the winding base 110, the magnetic core 108, and/or other electrically conductive objects.

In one embodiment, the multiple winding extensions 112 are configured to at least partially circumscribe the magnetic core 108, each of the multiple winding extensions 112 forming one or more windings. The multiple winding extensions 112 extend from the winding base 110. In one embodiment, each of the multiple winding extensions 112 comprises a base portion, a wrapping portion, and a connection portion. In a further embodiment, each of the multiple winding extensions 112 are configured to substantially circumscribe the magnetic core 108 multiple times to form multiple windings. The multiple winding extensions 112 may be bent, wrapped, folded, or otherwise formed to fit the magnetic core 108. In one embodiment, the multiple winding extensions 112 are bent, wrapped, folded, formed, or the like such that an assembler, manufacturer, or the like may place an integrated winding structure comprising the winding base 110 and the multiple winding extensions 112 over the magnetic core 108 in a single motion.

Each of the multiple winding extensions 112, in one embodiment, comprises an electrical connection surface that is suitable for use as an electrical input or output. In another embodiment, the multiple winding extensions 112 may comprise an electrically insulating coating configured to prevent a short circuit between separate winding extensions 112, and/or between the multiple winding extensions 112 and the magnetic core 108, or other electrically conductive objects. In one embodiment, one or more of the electrical connection surfaces of the winding base 110 and of the multiple winding extensions 112 is electrically coupled to the circuit board 102, and may operatively attach the magnetic core 108 to the circuit board 102.

In one embodiment, the output electrical device 116 is configured to receive an output from an integrated winding structure comprising the winding base 110 and the multiple winding extensions 112. The output electrical device 116, in one embodiment, is electrically coupled to one or more of the winding base 110 and the multiple winding extensions 112. In one embodiment, the output electrical device 116 is coupled to the winding base 110, and each of the multiple winding extensions 112 form a winding such as an inductor or transformer winding that are connected in parallel at their outputs by the winding base 110. In another embodiment, the output electrical device 116 comprises one or more electrical devices, electrical connections, or the like that are electrically coupled to one or more of the multiple winding extensions 112, and each of the multiple winding extensions 112 form a winding such as an inductor or transformer winding that are connected in parallel at their inputs by the winding base 110.

In one embodiment, the output 118 comprises an electrical output of the system 100. The output 118, in one embodiment, is coupled to the output electrical device 116. The output 118, in one embodiment, is configured to be electrically coupled to an electrical load such as an electrical system, module, circuit, device, or the like, and may provide electric power, an electrical signal, or the like to the electrical load. In a further embodiment, the output 118 is coupled to one or more of the winding base 110 and the multiple winding extensions 112 directly instead of through the output electrical device 116.

Figure 2A:
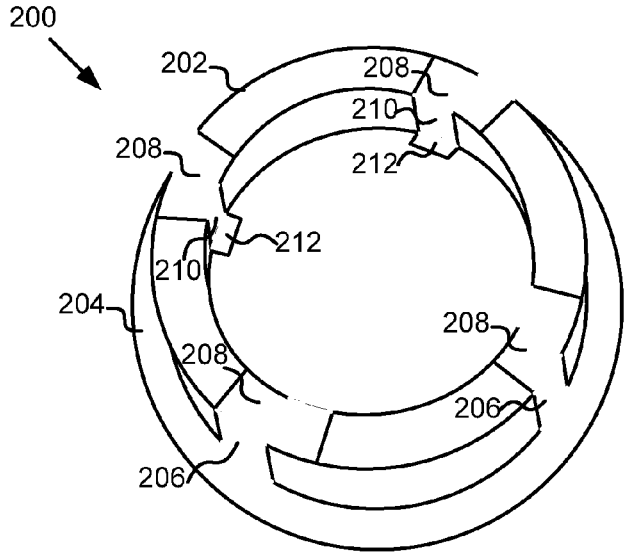
FIG. 2A is a schematic block diagram illustrating one embodiment of a magnetic core with multiple windings in accordance with the present invention.

FIG. 2A depicts one embodiment of a magnetic core with multiple windings 200. In one embodiment, the magnetic core with multiple windings 200 comprises a magnetic core 202, a winding base 204, and multiple winding extensions each comprising a base portion 206, a wrapping portion 208, a connection portion 210, and an electrical connection surface 212.

In one embodiment, the magnetic core 202 is substantially similar to the magnetic core 108 of FIG. 1 and the winding base 204 is substantially similar to the winding base 110 of FIG. 1. In the depicted embodiment, the magnetic core 202 comprises a substantially toroidal shape, and the winding base 204 comprises a substantially circular shape. In the depicted embodiment, the winding base 204 is disposed substantially outside of the perimeter of the magnetic core 202, substantially circumscribing the magnetic core 202. In other embodiments, the winding base 204 may be disposed substantially beneath or within the perimeter of the magnetic core 202.

In one embodiment, the multiple winding extensions each comprising a base portion 206, a wrapping portion 208, a connection portion 210, and an electrical connection surface 212 are substantially similar to the multiple winding extensions 112 of FIG. 1. In another embodiment, the base portion 206 is configured to extend from the winding base 204 along a first face of the magnetic core 202, the wrapping portion 208 is configured to extend from the base portion 206 along at least a second face of the magnetic core 202, the connection portion 210 is configured to extend from the wrapping portion 208 along a third face of the magnetic core 202, and the connection portion 210 comprises the electrical connection surface 212. Each face may comprise a separate exterior wall of the magnetic core 202, or may comprise separate portions of the same exterior wall of the magnetic core 202.

In the depicted embodiment, each of the base portions 206, the wrapping portions 208, the connection portions 210, and the electrical connection surfaces 212 are formed with a fold, joint, bend, or the like between them such that the integrated winding structure comprising the winding base 204, the base portions 206, the wrapping portions 208, the connection portions 210, and the electrical connection surfaces 212 may be placed over the magnetic core 202 in a single motion. In one embodiment, each coupled base portion 206, wrapping portion 208, and connection portion 210 is configured to form a winding around the magnetic core 202. In a further embodiment, the wrapping portions 208 are each configured to substantially circumscribe the magnetic core 202 one or more times forming one or more windings around the magnetic core 202. In one embodiment, the base portions 206, the wrapping portions 208, and the connection portions 210 comprise a coating, the coating comprising an electrically isolating material. In a further embodiment, the electrical connection surfaces 212 do not comprise a coating. In one embodiment, one or more of the electrical connection surfaces 212 and/or the winding base 204 are electrically coupled to an electrical device such as a surface board such that the magnetic core 202 is operatively attached to the electrical device.

Figure 2B:
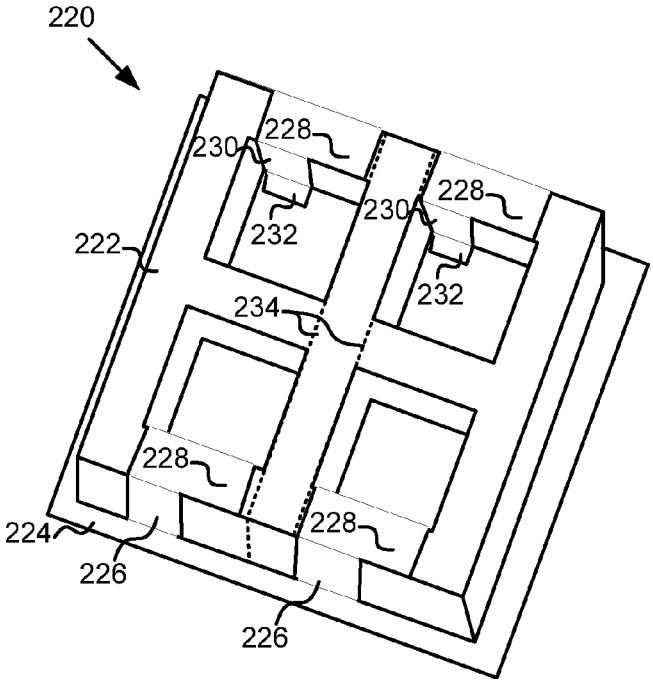
FIG. 2B is a schematic block diagram illustrating another embodiment of a magnetic core with multiple windings in accordance with the present invention.

FIG. 2B depicts another embodiment of a magnetic core with multiple windings 220. In one embodiment, the magnetic core with multiple windings 220 comprises a magnetic core 222, a winding base 224, one or more base portions 226, one or more wrapping portions 228, one or more connection portions 230, one or more electrical connection surfaces 232, and a binding 234. In one embodiment, the magnetic core with multiple windings 220 is substantially similar to the magnetic core with multiple windings 200 of FIG. 2A, and/or the magnetic core 108, the winding base 110, and the multiple winding extensions 112 of FIG. 1.

In the depicted embodiment, the magnetic core 222 comprises an E type magnetic core having an EIE structure, with an I piece that the binding 234 binds to the open sides of two E pieces. In one embodiment, the binding 234 is substantially similar to the binding 114 of FIG. 1. In the depicted embodiment, the winding base 224 is substantially rectangular, and is disposed substantially outside of the perimeter of the magnetic core 222, substantially circumscribing the magnetic core 222. In other embodiments, the winding base 224 may be disposed substantially beneath or within the perimeter of the magnetic core 222. In one embodiment, the base portions 226, the wrapping portions 228, the connection portions 230, and the electrical connection surfaces 232 are substantially similar to the base portions 206, the wrapping portions 208, the connection portions 210, and the electrical connection surfaces 212 of FIG. 2A.

Figure 2C:
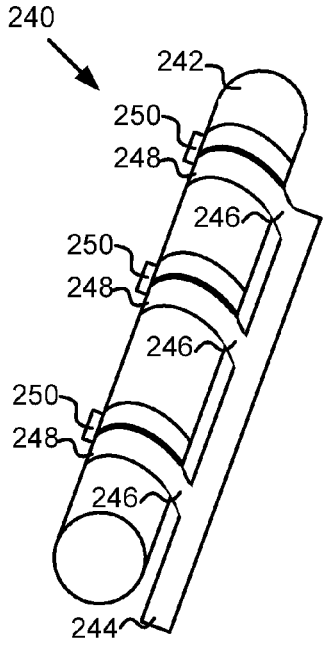
FIG. 2C is a schematic block diagram illustrating a further embodiment of a magnetic core with multiple windings in accordance with the present invention.

FIG. 2C depicts a further embodiment of a magnetic core with multiple windings 240. In one embodiment, the magnetic core with multiple windings 240 comprises a magnetic core 242, a winding base 244, one or more base portions 246, one or more wrapping portions 248, and one or more connection portions 250. In one embodiment, the magnetic core with multiple windings 240 is substantially similar to the magnetic core with multiple windings 200 of FIG. 2A, the magnetic core with multiple windings 220 of FIG. 2B, and/or the magnetic core 108, the winding base 110, and the multiple winding extensions 112 of FIG. 1.

In one embodiment, the magnetic core 242 comprises a bar-type magnetic core (also referred to as an I or a rod). The magnetic core 242 may be round, as depicted, square, rectangular, or another shape. The winding base 244, in one embodiment, is disposed substantially parallel to the magnetic core 242. In one embodiment, the base portions 246, the wrapping portions 248, and the connection portions 250 are substantially similar to the base portions 226, the wrapping portions 228, and the connection portions 230 of FIG. 2B and/or the base portions 206, the wrapping portions 208, and the connection portions 210 of FIG. 2A. In the depicted embodiment, the wrapping portions 248 are configured to substantially circumscribe the magnetic core 242, such that each coupled base portion 246, wrapping portion 228, and connection portion 230 comprises two windings around the magnetic core 242. In other embodiments, the wrapping portions 248 may circumscribe the magnetic core 242 more than two times, or may extend along a face of the magnetic core 242, not completely circumscribing the magnetic core 242.

Figure 3A:
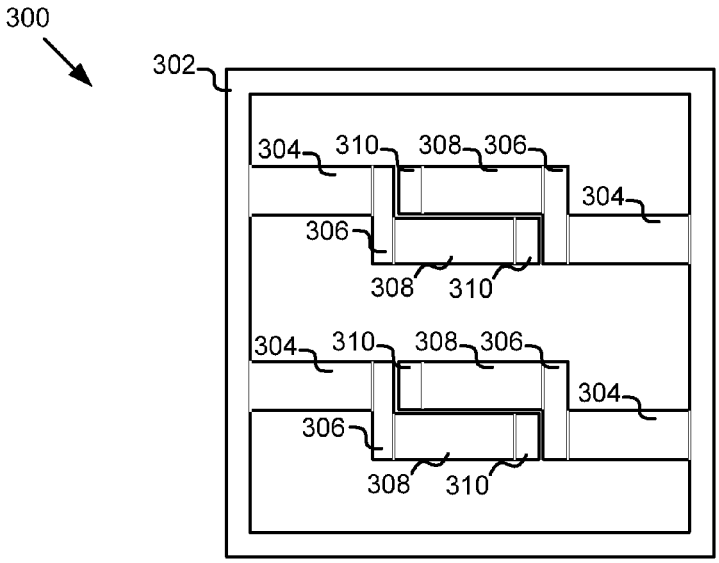
FIG. 3A is a schematic block diagram illustrating one embodiment of an unbent integrated winding structure in accordance with the present invention
Figure 3B:
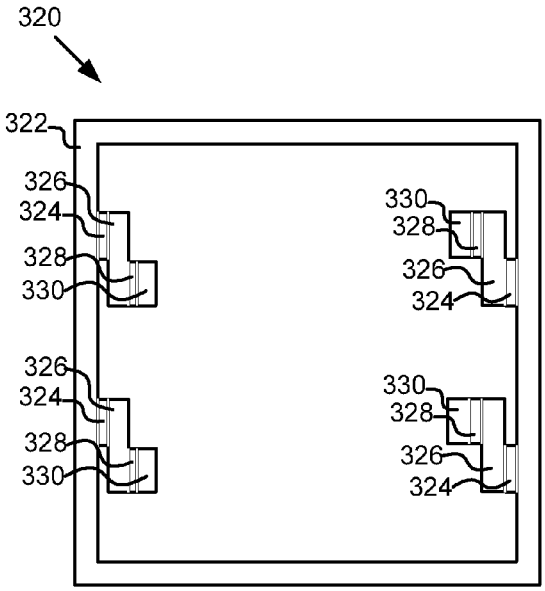
FIG. 3B is a schematic block diagram illustrating one embodiment of a top view of a pre-bent integrated winding structure in accordance with the present invention.
Figure 3C:
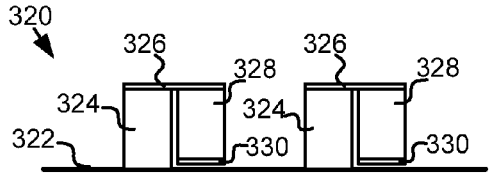
FIG. 3C is a schematic block diagram illustrating one embodiment of a side view of a pre-bent integrated winding structure in accordance with the present invention.
Figure 3D:
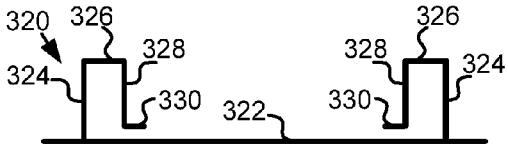
FIG. 3D is a schematic block diagram illustrating one embodiment of a front view of a pre-bent integrated winding structure in accordance with the present invention.
Figure 3E:
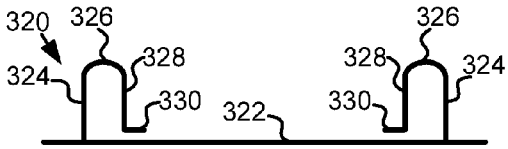
FIG. 3E is a schematic block diagram illustrating another embodiment of a front view of a pre-bent integrated winding structure in accordance with the present invention.

FIG. 3A depicts one embodiment of an unbent integrated winding structure 300. In one embodiment, the unbent integrated winding structure 300 comprises a winding base 302, one or more base portions 304, one or more wrapping portions 306, one or more connection portions 308, and one or more electrical connection surfaces 310. In one embodiment, the unbent integrated winding structure 300 is formed from a single sheet of electrically conductive material, such as copper, aluminum, or the like. The unbent integrated winding structure 300, in a further embodiment, may be stamped, etched, cut, pressed, or otherwise formed from the single sheet of electrically conductive material.

In one embodiment, the winding base 302, the base portions 304, the wrapping portions 306, the connection portions 308, and the electrical connection surfaces 310 are unbent and substantially flat after being formed. In another embodiment, one or more of the base portions 304, the wrapping portions 306, the connection portions 308, and the electrical connection surfaces 310 may be bent, curved, wrapped, or the like during the formation of the unbent integrated winding structure 300. In a further embodiment, one or more perforations, markings, joints, or the like are formed along bend lines between the winding base 302, the base portions 304, the wrapping portions 306, the connection portions 308, and the electrical connection surfaces 310 during the formation of the unbent integrated winding structure 300.

In one embodiment, the base portions 304, the wrapping portions 306, the connection portions 308, and the electrical connection surfaces 310 are formed from material in the middle of the winding base 302. In another embodiment, the wrapping portions 306, the connection portions 308, and the electrical connection surfaces 310 are formed from material outside of the winding base 302 and/or material extending from the winding base 302.

FIG. 3B, FIG. 3C, FIG. 3D, and FIG. 3E depict various embodiments of a pre-bent integrated winding structure 320. In one embodiment, the pre-bent integrated winding structure 320 comprises a winding base 322, one or more base portions 324, one or more wrapping portions 326, one or more connection portions 328, and one or more electrical connection surfaces 330. In one embodiment, the pre-bent integrated winding structure 320 comprises the unbent integrated winding structure 300 that is bent, curved, wrapped, or the like.

In the depicted embodiment, the base portions 324 are bent away from the winding base 322 at a substantially perpendicular angle, the wrapping portions 326 are bent away from the base portions 324 at a substantially perpendicular angle towards an opposite side of the base portions 324 as the winding base 322, the connection portions 328 are bent away from the wrapping portions 326 at a substantially perpendicular angle towards the winding base 322, and the electrical connection surfaces 330 are bent away from the connection portions 328 at a substantially perpendicular angle towards an opposite side of the connection portions 328 as the wrapping portions 326.

In the depicted embodiment, each coupled base portion 324, wrapping portion 326, connection portion 328, and electrical connection surface 330 comprises a winding extension, and are formed in an inverted U type shape extending from the winding base 322 towards the center of the winding base 322. In another embodiment, each coupled base portion 324, wrapping portion 326, connection portion 328, and electrical connection surface 330 may extend from the winding base 322 towards the outside of the winding base 322. In another embodiment, each inverted U shaped winding extension comprising a coupled base portion 324, wrapping portion 326, connection portion 328, and electrical connection surface 330 is configured to be positioned over a magnetic core in a single motion.

Using the pre-bent integrated winding structure 320 allows manufacturers to increase the efficiency and to decrease the cost of manufacturing and assembling magnetic cores and windings because the pre-bent integrated winding structure 320 is formed from a single sheet of material and may be formed for efficient assembly. In embodiments where the pre-bent integrated winding structure 320 is sized to fit over a magnetic core, it may be placed over the magnetic core in a single motion or step, and then connected to a circuit board or other electrical device. The manufacturing and assembly process may be performed manually, automated, or a combination of both. The electrical connection surfaces 330 of the pre-bent integrated winding structure 320 may, in another embodiment, be disposed to align with corresponding electrical connection surfaces on a circuit board or another electrical device, for efficient connection to an electric circuit. The pre-bent integrated winding structure 320, in certain embodiments, may also attach a magnetic core to a circuit board or to another electrical device, reducing the amount of additional fasteners and materials used in assembly. The pre-bent integrated winding structure 320 and a single magnetic core may also be used in the place of multiple magnetic cores having single windings, providing a smaller installed footprint and a lower cost.

The schematic flow chart diagrams that follow are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Figure 4:
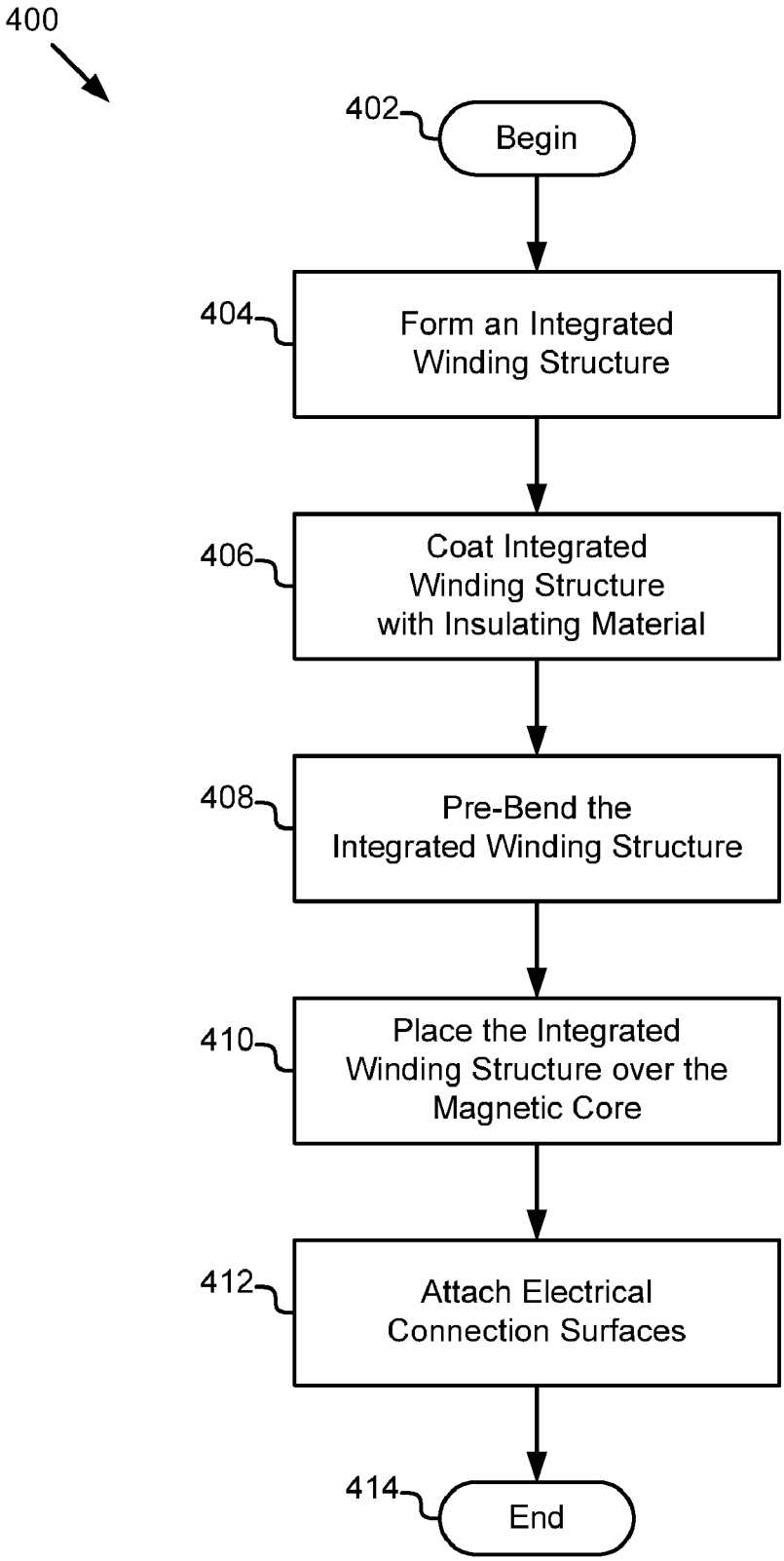
FIG. 4 is a schematic flow chart diagram illustrating one embodiment of a method for manufacturing an integrated winding structure in accordance with the present invention.

FIG. 4 depicts one embodiment of a method 400 for manufacturing an integrated winding structure. The method 400 begins 402, and a manufacturer forms 404 an unbent integrated winding structure 300 from a single sheet of electrically conductive material. The manufacturer may form 404 the unbent integrated winding structure 300 by stamping, etching, cutting, pressing, or otherwise forming 404 the unbent integrated winding structure 300 from the single sheet of electrically conductive material.

In one embodiment, the manufacturer coats 406 the unbent integrated winding structure 300 with an electrically insulating material. Examples of electrically insulating materials include polymers, silicone, rubber, waxes, and the like. In another embodiment, the manufacturer pre-bends 408 the unbent integrated winding structure 300 and places 410 the pre-bent integrated winding structure 320 over the magnetic core 108. The manufacturer, in one embodiment, may place 410 the pre-bent integrated winding structure 320 over the magnetic core 108 in a single motion. In a further embodiment, the manufacture may bend 408 and/or wrap the unbent integrated winding structure 300 directly around the magnetic core 108.

The manufacturer, in one embodiment, attaches 412 the electrical connection surfaces of the winding base 110 and of the multiple winding extensions 112 to the one or more electrical devices 104, the output electrical device 116, and/or the output 118. In a further embodiment, the manufacturer attaches 412 the electrical connection surfaces of the winding base 110 and of the multiple winding extensions 112 to the circuit board 102. In another embodiment, attaching 412 the electrical connection surfaces of the winding base 110 and of the multiple winding extensions 112 electrically to the circuit board 102 or to another electric device operatively attaches the magnetic core 108 to the circuit board 102 or to another electric device. The manufacturer may attach 412 the electrical connection surfaces of the winding base 110 and of the multiple winding extensions 112 using solder, electrical connectors, or the like and the method 400 ends 414.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for manufacturing an apparatus to combine multiple windings on a magnetic core, the method comprising:

forming an integrated winding structure from a single sheet of electrically conductive material, the integrated winding structure comprising a winding base and multiple winding extensions extending from the winding base as a continuous piece of the electrically conductive material, the winding base comprising an electrical connection surface, the multiple winding extensions each comprising a base portion configured to extend from the winding base along a first face of a fully assembled magnetic core;

a wrapping portion configured to extend from the base portion along a second face of the fully assembled magnetic core; and a connection portion configured to extend from the wrapping portion along a third face of the fully assembled magnetic core, the connection portion comprising an electrical connection surface, wherein the base portion, the wrapping portion, and the connection portion of each winding extend from the winding base such that the integrated winding structure is shaped for placement over the fully assembled magnetic core in a single motion.

2. The method of claim 1, wherein the method further comprises coating at least a portion of the multiple winding extensions with an electrically insulating material.

3. The method of claim 1, wherein the method further comprises pre-bending the integrated winding structure.

4. The method of claim 3, wherein the pre-bending each of the multiple winding extensions comprises bending each of the multiple winding extensions between the winding base and the base portion, between the base portion and the wrapping portion, and between the wrapping portion and the connection portion.

5. The method of claim 3, wherein the method further comprises placing the integrated winding structure over the fully assembled magnetic core in a single motion.

6. The method of claim 1, wherein the method further comprises electrically attaching at least one of the electrical connection surfaces of the integrated winding structure to a circuit board.

7. The method of claim 1, wherein the multiple winding extensions are formed from the middle of the winding base.

* * * * *